US011703302B2

(12) United States Patent
DiBlasio et al.

(10) Patent No.: US 11,703,302 B2
(45) Date of Patent: Jul. 18, 2023

(54) DYNAMIC SEALING CHAMBER MAGAZINE

(71) Applicant: UMAREX USA, INC., Fort Smith, AR (US)

(72) Inventors: Alexander Robert DiBlasio, Jamison, PA (US); Stephen R. Lamboy, Fort Smith, AR (US)

(73) Assignee: UMAREX USA, INC., Fort Smith, AR (US)

( * ) Notice: Subject to any disclaimer, the term of this patent is extended or adjusted under 35 U.S.C. 154(b) by 0 days.

(21) Appl. No.: 17/893,319

(22) Filed: Aug. 23, 2022

(65) Prior Publication Data

US 2023/0046456 A1 Feb. 16, 2023

Related U.S. Application Data

(63) Continuation-in-part of application No. 17/187,763, filed on Feb. 27, 2021, now abandoned, which is a continuation of application No. 16/796,720, filed on Feb. 20, 2020, now Pat. No. 10,942,003, which is a continuation of application No. 16/141,857, filed on Sep. 25, 2018, now Pat. No. 10,605,562.

(60) Provisional application No. 62/563,031, filed on Sep. 25, 2017.

(51) Int. Cl.
*F41B 11/55* (2013.01)

(52) U.S. Cl.
CPC ..... *F41B 11/55* (2013.01)

(58) Field of Classification Search
CPC ..... F41B 11/00; F41B 11/50; F41B 11/51; F41B 11/54; F41B 11/55; F41B 11/72; F41A 9/25
USPC ..... 124/45, 56
See application file for complete search history.

(56) References Cited

U.S. PATENT DOCUMENTS 2,098,068 A * 11/1937 Skinner ..... F42B 8/06 102/444
2,713,859 A * 7/1955 Bradfield ..... F41A 9/25 42/15
3,212,489 A * 10/1965 Merz ..... F41B 11/54 124/36
3,741,189 A * 6/1973 Kester ..... F41B 11/62 124/48
4,004,565 A * 1/1977 Fischer ..... F41A 9/84 206/532

(Continued)

*Primary Examiner* — Alexander R Niconovich
(74) *Attorney, Agent, or Firm* — Eric B. Fugett; Mark A. Pitchford; Pitchford Fugett, PLLC

(57) ABSTRACT

A dynamic sealing chamber magazine for an air gun carries multiple projectiles for the air gun and sequentially places each projectile in line with the bore of the gun while serving as a chamber for the projectile and gun. Each chamber of the magazine is configured to temporarily seal to an air orifice and barrel bore of the air gun upon firing. Each chamber includes a hole and two tubular sleeves therein. A pressurized gas released into a chamber when the chamber is aligned with the air orifice and barrel bore and the gun is fired pushes the sleeves apart from inside the chamber and compresses the sleeves into sealing engagement with opposing breech surfaces of the gun surrounding the air orifice and barrel bore. The sleeves decompress, unseal, and retract to a static position when the gas pressure decreases below the elastic potential energy of the sleeves.

18 Claims, 20 Drawing Sheets

(56) References Cited

U.S. PATENT DOCUMENTS 4,004,566 A * 1/1977 Fischer ..... F41A 9/25 124/67
4,047,466 A * 9/1977 Berman ..... F42B 14/02 89/14.05
4,422,433 A * 12/1983 Milliman ..... F41A 9/28 124/48
4,760,834 A * 8/1988 Chevalier ..... F41A 9/84 42/15
4,771,757 A * 9/1988 Chevalier ..... F42B 39/08 42/15
4,819,609 A * 4/1989 Tippmann ..... F41B 11/54 124/66
4,850,328 A * 7/1989 Sindel ..... F41B 11/55 124/66
4,986,251 A * 1/1991 Lilley ..... F41B 11/55 124/52
5,150,701 A * 9/1992 Wackrow ..... F41B 11/57 124/52
5,160,795 A * 11/1992 Milliman ..... F41B 11/723 124/48
5,565,642 A * 10/1996 Heitz ..... F42B 39/08 89/14.05
6,470,871 B2 * 10/2002 Casas-Salva ..... F41B 11/54 124/67
6,745,755 B2 * 6/2004 Piccini ..... F41A 9/73 124/49
7,159,584 B2 * 1/2007 Maeda ..... F41A 9/73 89/33.02
8,011,355 B2 * 9/2011 Kawashima ..... F42B 5/145 124/57
8,291,894 B2 * 10/2012 Barwick, Jr. ..... F41B 11/55 124/45
8,756,843 B1 * 6/2014 Cantrell ..... F41A 19/06 42/6
8,783,237 B2 * 7/2014 Torre ..... F41B 11/70 124/45
9,664,475 B1 * 5/2017 Maggiore ..... F41B 11/54
10,066,896 B2 * 9/2018 Zhu ..... F41B 11/50
10,996,021 B2 * 5/2021 Colby ..... F41B 11/89
11,029,124 B2 * 6/2021 Call ..... F41A 9/45
11,098,976 B2 * 8/2021 Call ..... F41B 11/54
11,226,168 B2 * 1/2022 Kowalczyk, Jr. ..... F41B 11/54
11,353,282 B2 * 6/2022 Call ..... F41B 11/55
2001/0027786 A1 * 10/2001 Kunimoto ..... F41B 11/54 124/73

* cited by examiner

DYNAMIC SEALING CHAMBER MAGAZINE

CROSS-REFERENCES TO RELATED APPLICATIONS

This application is a continuation-in-part of U.S. Nonprovisional patent application Ser. No. 17/187,763 filed Feb. 27, 2021 and entitled "LINEAR CHAMBER MAGAZINE", which is a continuation of U.S. Nonprovisional patent application Ser. No. 16/796,720 filed Feb. 20, 2020 and entitled "LINEAR CHAMBER MAGAZINE" (which issued as U.S. Pat. No. 10,942,003 on Mar. 9, 2021), which is a continuation of U.S. Nonprovisional patent application Ser. No. 16/141,857 filed Sep. 25, 2018 and entitled "LINEAR CHAMBER MAGAZINE" (which issued as U.S. Pat. No. 10,605,562 on Mar. 31, 2020), which claims priority to U.S. Provisional Patent Application No. 62/563,031 entitled "LINEAR CHAMBER MAGAZINE" filed on Sep. 25, 2017, all of which are hereby incorporated by reference in their entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to magazines for air guns. More particularly, the present invention relates to magazines for large caliber air guns.

In small caliber air guns, rotary magazines are used to provide multiple shots without reloading. Projectiles used in small caliber air guns can be driven to acceptable speeds (e.g., 500 plus feet per second) without the need to seal the projectile into the bore or chamber of the air gun. Rotary magazines are commonly used in these rifles to provide multiple shots without reloading, and they rely on metal to metal (or plastic) contact to create the chamber and bore of the rifle.

In large caliber air guns (e.g., .30 caliber and larger) rotary magazines become impractical because they would require a diameter that would interfere with handling and operating characteristics of the rifle. Holding five to eight rounds in the rotary magazine would also result in a weight increase and weight change with repeated firing that is undesirable. Additionally, providing a perfectly aligned chamber and bore together with a sufficient seal from air orifice to chamber and chamber to barrel bore for a high-power air gun (e.g., in excess of 300 foot pounds of muzzle energy) is not practical with a rotary magazine. For these reasons, large caliber high-power air guns have been single shot bolt action (or break action).

BRIEF SUMMARY OF THE INVENTION

Aspects of the present invention provide a magazine for an air gun that advances upon actuation of a cocking mechanism. The magazine carries multiple projectiles for the air gun and translates perpendicular to the bore of the air gun to advance to the next projectile. The magazine places a series of projectiles in line with the bore of the gun while serving as a chamber for the projectile and gun and sealing to the air orifice and barrel bore of the air gun.

In one aspect, a magazine for an air gun includes a plurality of holes, a rear rim, and a front rim. Each hole of the plurality of holes extends through the magazine. Each hole is configured to receive a projectile and thus form a chamber of the air gun when in use. The rear rim extends from a rear face of the magazine. The rear rim incircles a hole of the plurality of holes extending through the magazine. The front rim extends from a front face of the magazine. The front rim encircles the hole of the reality of holes extending through the magazine.

In another aspect, a magazine for an air gun includes a plurality of holes and a dovetail. Each hole of the plurality of holes extends through the magazine. Each hole is configured to receive a projectile and thus form a chamber of the air gun when in use. The plurality of holes extend longitudinally and are spaced laterally from one another across the magazine. The dovetail extends laterally along the magazine. The dovetail is configured to engage a track of the air gun to align the magazine within the air gun.

In another aspect, a magazine for an air gun includes a plurality of holes extending through the magazine. Each hole of said plurality of holes is configured to receive a projectile. The plurality of holes extend longitudinally interspace laterally from one another across the magazine. Each hole of the plurality of holes has a longitudinal axis that extends through a center of the hole and beyond the front face and the rear face of the magazine such that the longitudinal axes of the plurality of holes are at a common elevation when the magazine is held in an upright position.

Other aspects of the present invention provide a magazine for an air gun with multiple dynamic sealing chambers that seal to the air orifice and barrel bore of the gun during firing, then unseal from the air orifice and barrel bore after the projectile has exited the chamber and chamber pressure had dissipated to safe levels, so that the magazine can be easily advanced to the next chamber.

Accordingly, in one aspect, a magazine for an air gun includes a plurality of chambers extending through the magazine. Each chamber is configured to receive a projectile and temporarily seal against at least one surface of the breech of the air gun when the projectile is received in the chamber, the chamber is aligned with a barrel of the air gun, and a pressurized gas provided by the air gun is released into the chamber.

In another aspect, a magazine for an air gun includes a magazine body having a front face and a rear face, and a plurality of chambers extending through the magazine body. Each chamber is configured to receive a projectile and comprises a hole extending from the front face to the rear face of the magazine body, a first sleeve disposed within the hole, and a second sleeve disposed within the hole colinear to the first sleeve. The first sleeve and the second sleeve are configured to sealingly engage respective first and second breech surfaces of the air gun upon release into the chamber of a pressurized gas provided by the air gun when the projectile is received in the chamber and the chamber is aligned with a barrel of the air gun In yet another aspect, a magazine for an air gun includes a magazine body having a front face and a rear face, and a plurality of chambers extending through the magazine body. Each chamber is configured to receive a projectile and comprises a hole extending from the front face to the rear face of the magazine body, a rear sleeve disposed within the hole, and a forward sleeve disposed within the hole adjacent the rear sleeve. The rear sleeve and the forward sleeve are formed from a synthetic polymeric material and are configured to be pushed apart by a pressurized gas upon release of the pressurized gas into the chamber when the projectile is received in the chamber and the chamber is aligned with an air orifice and a barrel of the air gun such that said sleeves extend out of the hole in opposite directions and compressively seal against the air orifice and the barrel of the air gun, then decompress and unseal from the air orifice and barrel when a force applied to the said sleeves by the pressurized gas decreases below an elastic potential energy of said sleeves.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
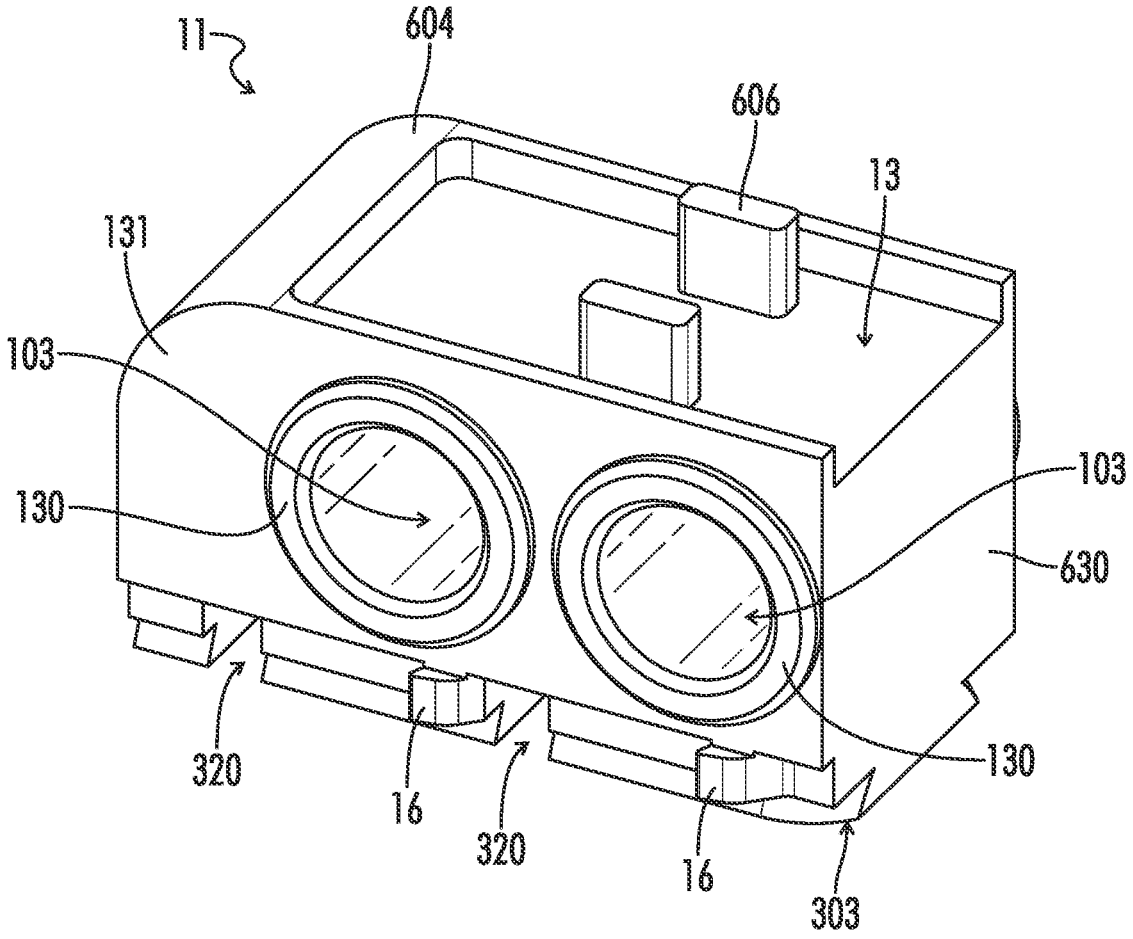
FIG. 1 is a rear isometric view of a linear magazine for an air gun.
Figure 2:
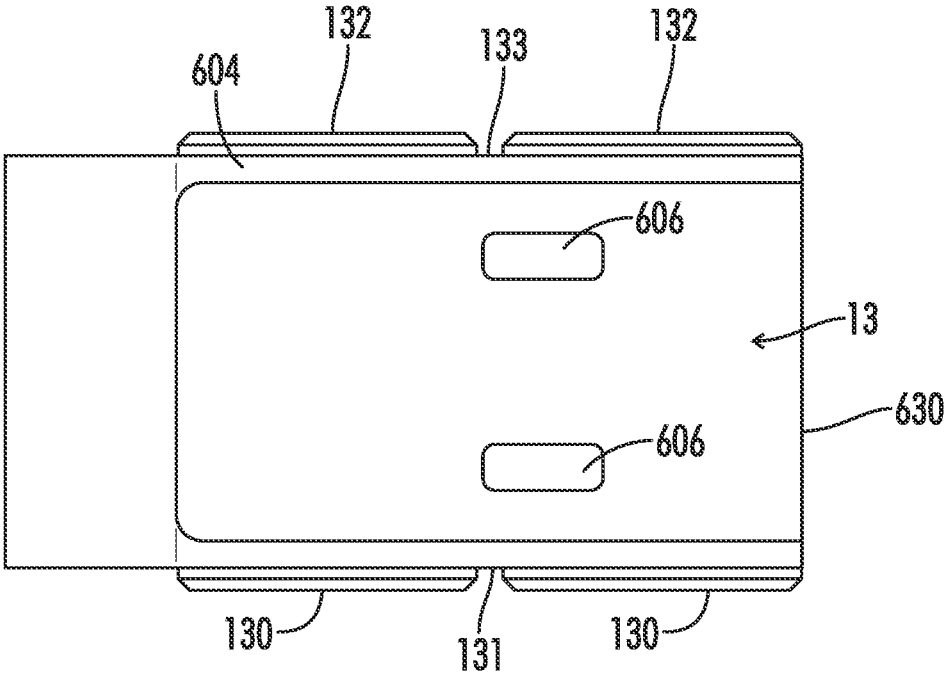
FIG. 2 is a top perspective view of the magazine of FIG. 1.
Figure 3:
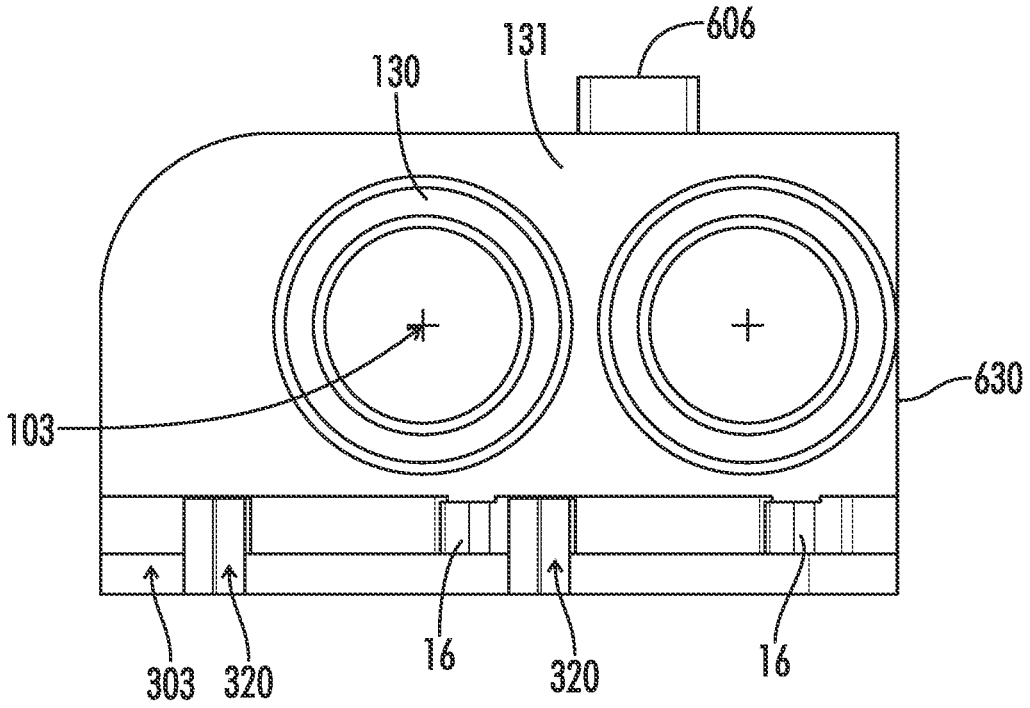
FIG. 3 is a rear perspective view of the magazine of FIG. 1.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The upright position is determined when the magazine is properly loaded into the rifle with the rifle held in a level shooting position. As described herein, the magazine is viewed from the rear (unless described otherwise), the rear of the magazine being the side nearest the butt of the rifle when the magazine is properly loaded into the rifle. Left and right are described with respect to a right-handed rifle. One of ordinary skill in the art will appreciate that features may be reversed from left to right to adapt a rifle to a left-handed shooter. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

As used herein, air gun and air rifle are interchangeable. Although it is expected that the magazines described herein will typically be used with high-power large caliber air rifles suitable for large game hunting, it is contemplated that the magazines described herein may be used with smooth bore air guns of any caliber and capacity. Additionally, although the magazines described herein are expected to be typically used with pre-charged pneumatic air rifles, the magazines may be used with any kind of air gun including helium operated guns and manually pressurized guns.

As used herein, the term "pressurized gas" does not necessarily refer to a single gas. Rather, a pressurized gas can be a single gas (e.g., helium) or a mixture of one or more gasses (e.g., air).

Referring to FIGS. 1-10, in one embodiment, a magazine 11 for an air gun 105 includes a plurality of holes 103, a rear rim 130, and a front rim 132. Each hole 103 of the plurality of holes is configured to receive a projectile (e.g., bullet). In one embodiment, each hole 103 of the plurality of holes has a longitudinal axis that extends through the center of the hole 103 and beyond the front face 133 and the rear face 131 of the magazine 11 such that the longitudinal axes of the plurality of holes 103 are at a common elevation when the magazine 11 is held in the upright position. Each of the holes 103 are laterally spaced from one another across the magazine 11. When a hole 103 of the plurality of holes has its projectile in a position to be fired from the air gun 105, the longitudinal axis of that hole 103 aligns with a longitudinal axis of a barrel 505 of the air gun 105.

The front rim 132 extends from a front face 133 of the magazine 11. The front rim 132 encircles the hole 103 of the plurality of holes extending through the magazine 11. In one embodiment, the front rim 132 is configured to engage a barrel seal 506 of the air gun 105. The barrel seal 506 is configured and air from escaping the air gun 105 where the magazine 11 interfaces with a barrel 505 of the air gun 105.

The rear rim 130 extends from a rear face 131 of the magazine 11. The rear rim 130 encircles a hole 103 of the plurality of holes extending through the magazine 11. In one embodiment, the rear rim 130 is configured to engage an air orifice seal 508 of the air gun 105. The air orifice seal 508 is configured to prevent air from escaping the air gun where the magazine 11 interfaces with an air output orifice 507 of the air gun 105.

Figure 4:
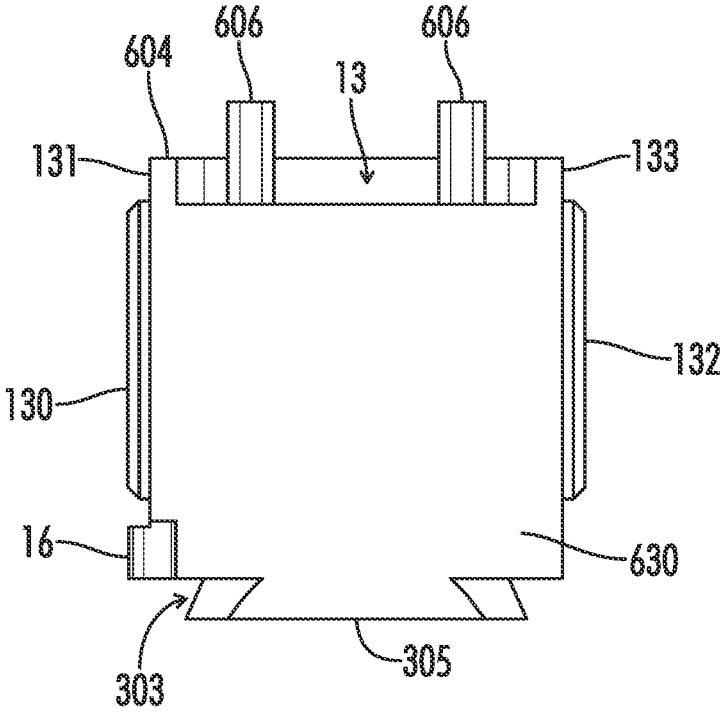
FIG. 4 is a right side perspective view of the magazine of FIG. 1
Figure 5:
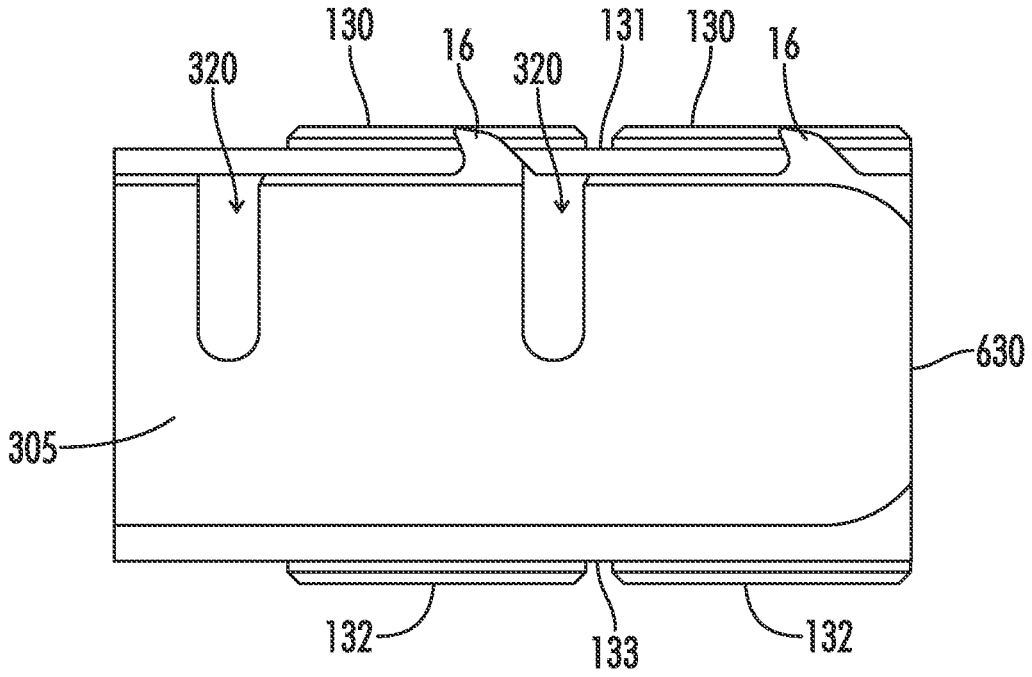
FIG. 5 is a bottom perspective view of the magazine of FIG. 1.
Figure 6:
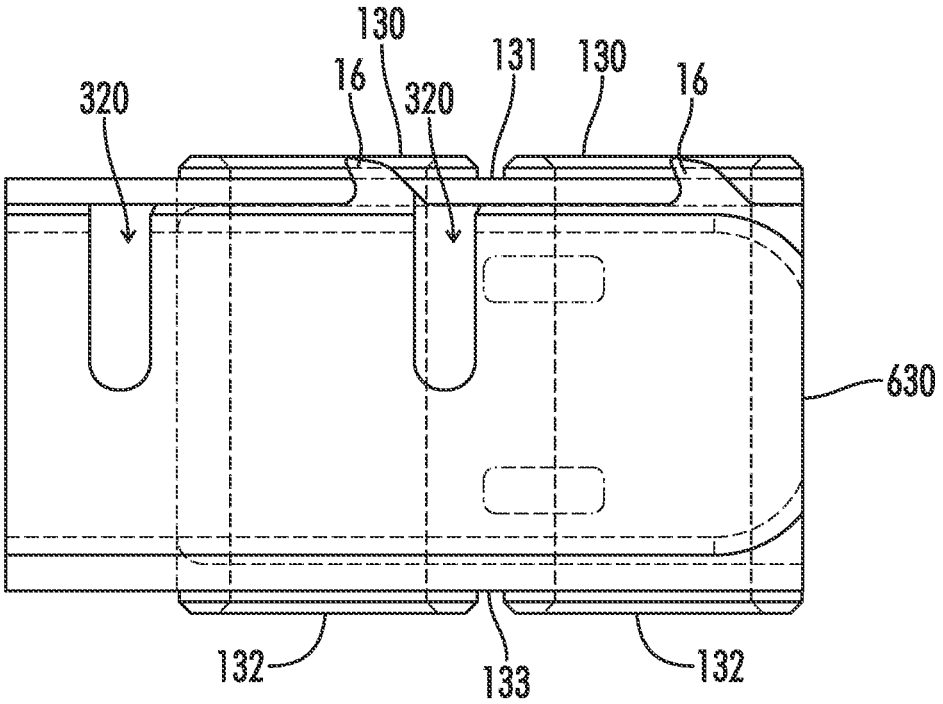
FIG. 6 is a bottom x-ray or see-through view of the magazine of FIG. 1.
Figure 7:
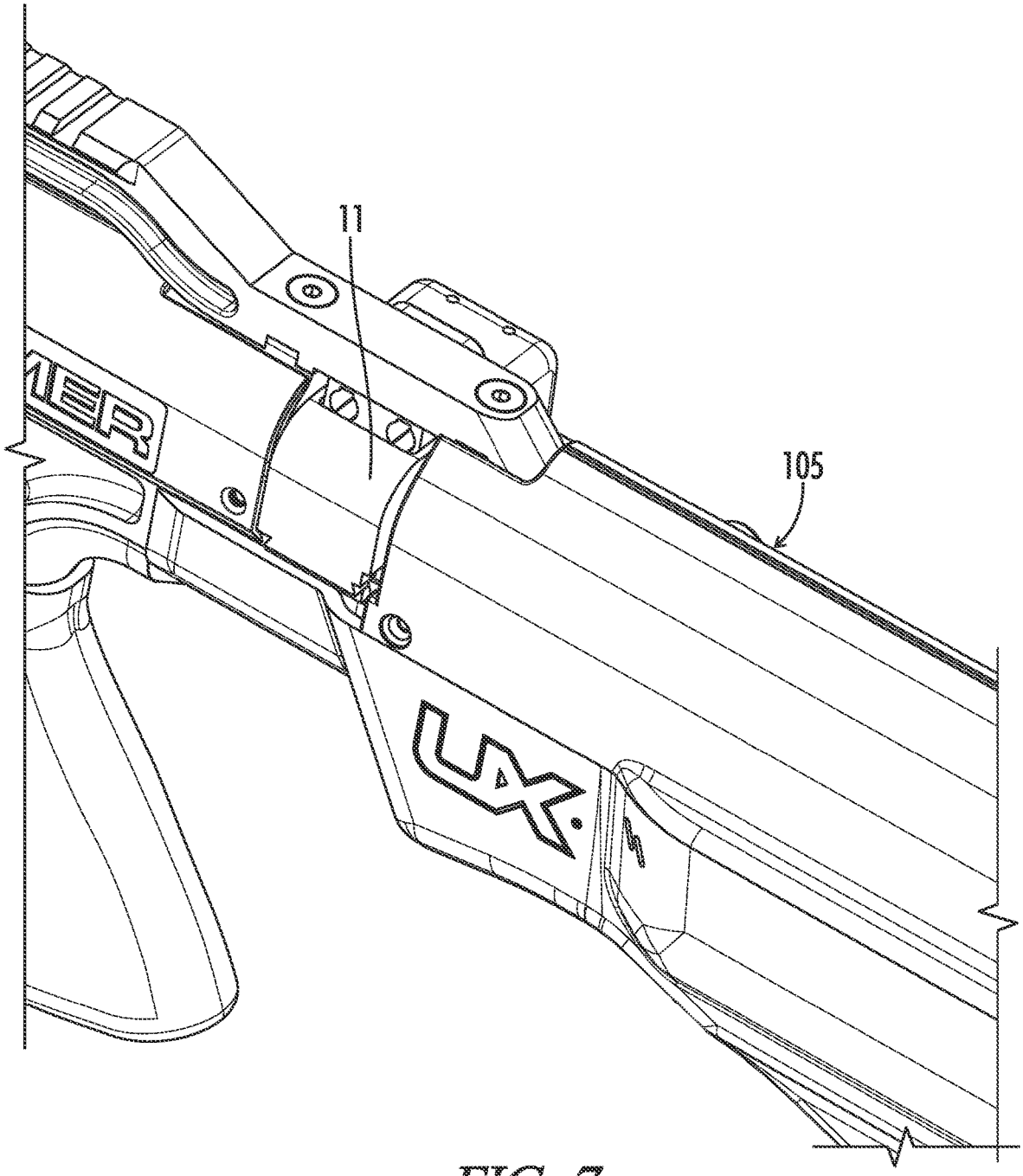
FIG. 7 is an elevated rear perspective view of the magazine of FIG. 1 loaded in an air gun.
Figure 8:
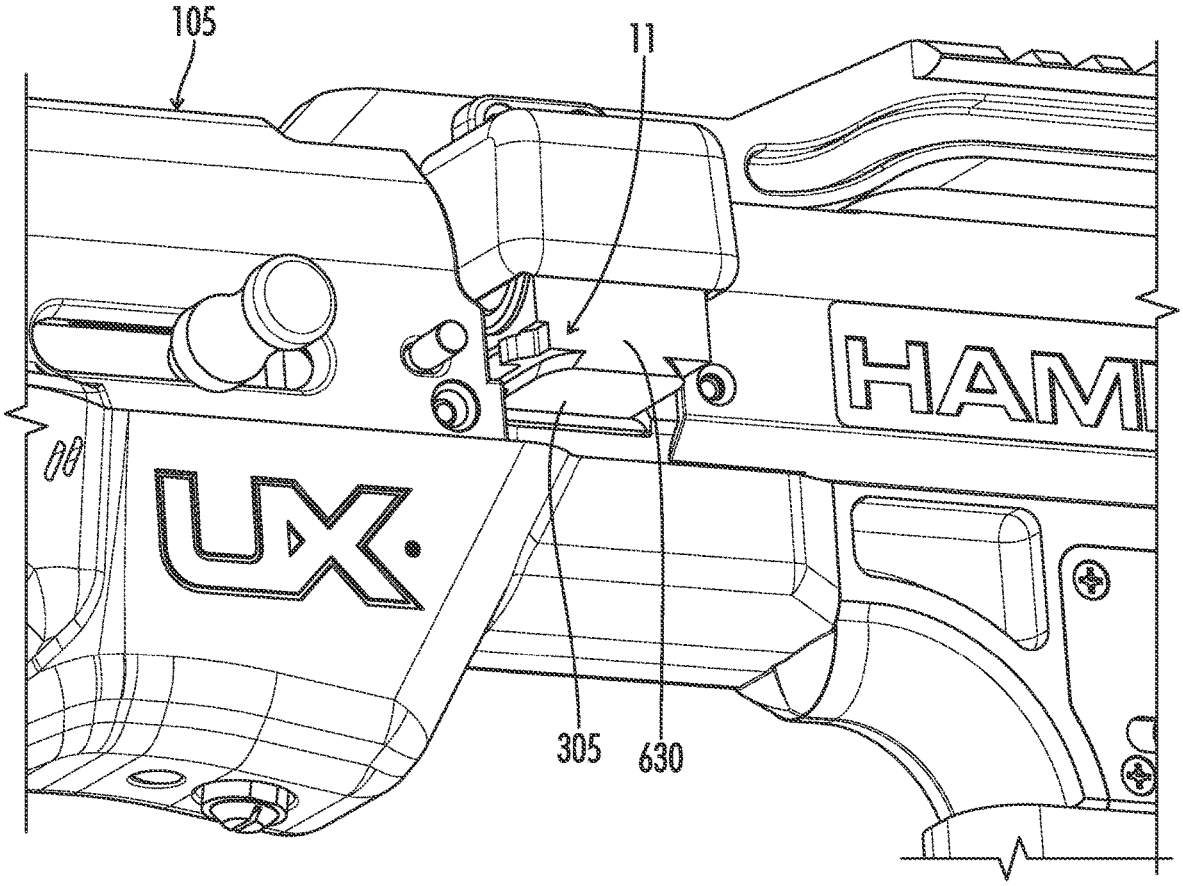
FIG. 8 is a depressed rear right perspective view of the magazine of FIG. 1 loaded in an air gun.
Figure 9:
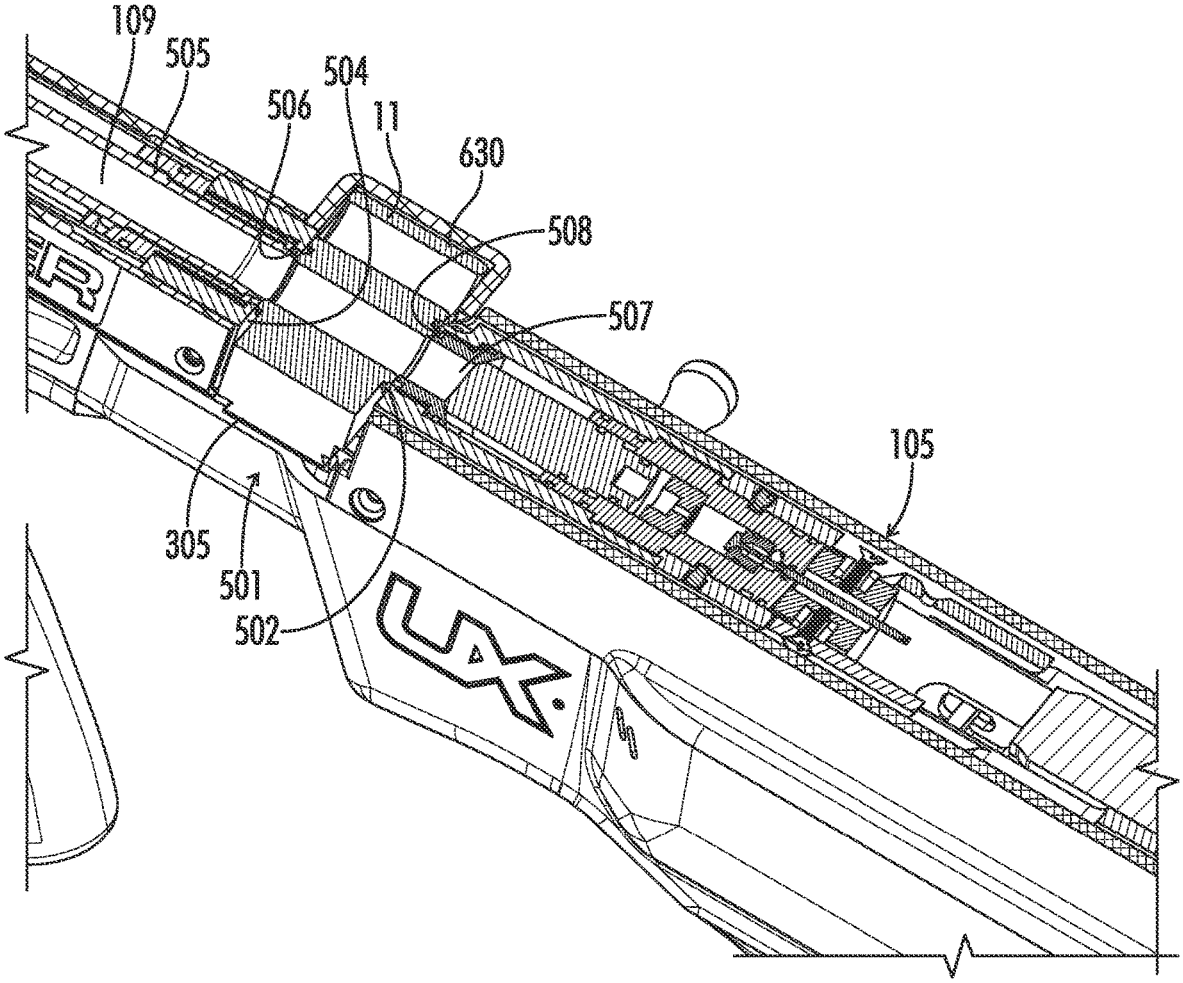
FIG. 9 is a rear left isometric cutaway view of the magazine of FIG. 1 loaded in an air gun, wherein the cutaway is taken along a longitudinal axis of a hole through the magazine.
Figure 10:
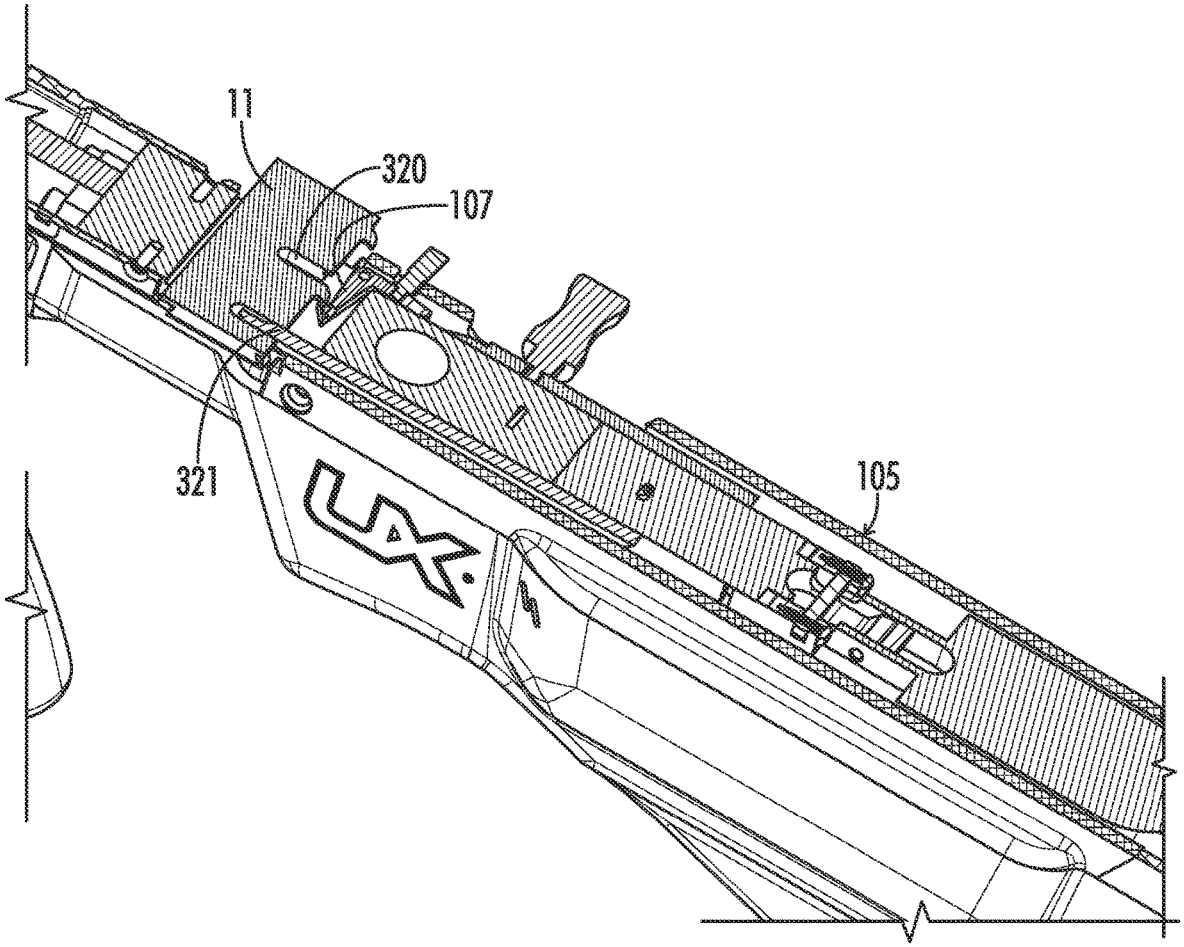
FIG. 10 is a rear left isometric cutaway view of the magazine of FIG. 1 loaded in an air gun, wherein the cutaway is taken at a top of a notch of the magazine.
Figure 11:
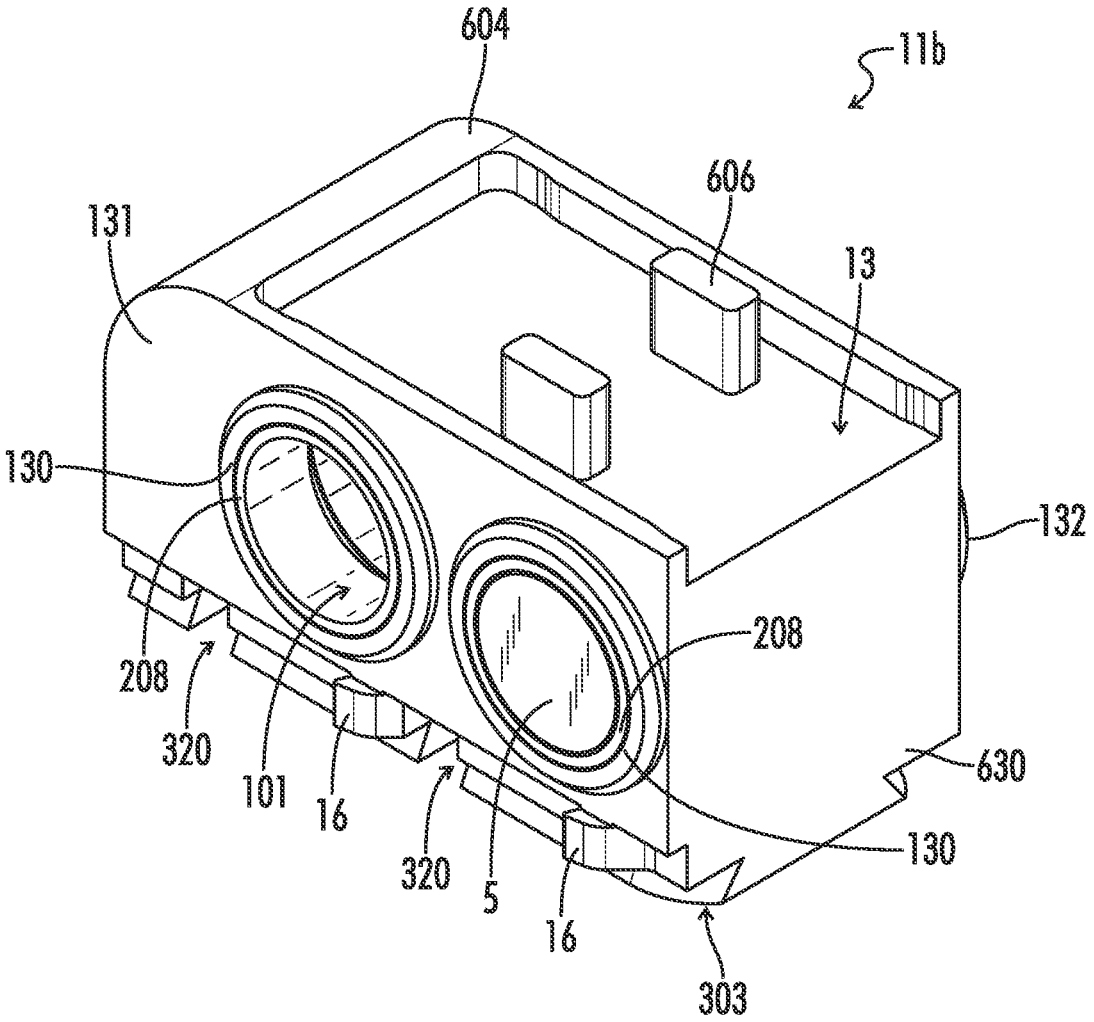
FIG. 11 is a rear isometric view of an embodiment of a dynamic sealing chamber magazine for an air gun showing the chambers of the magazine in a static, non-sealing position with a projectile received (i.e., loaded) in one chamber ready for firing.
Figure 12:
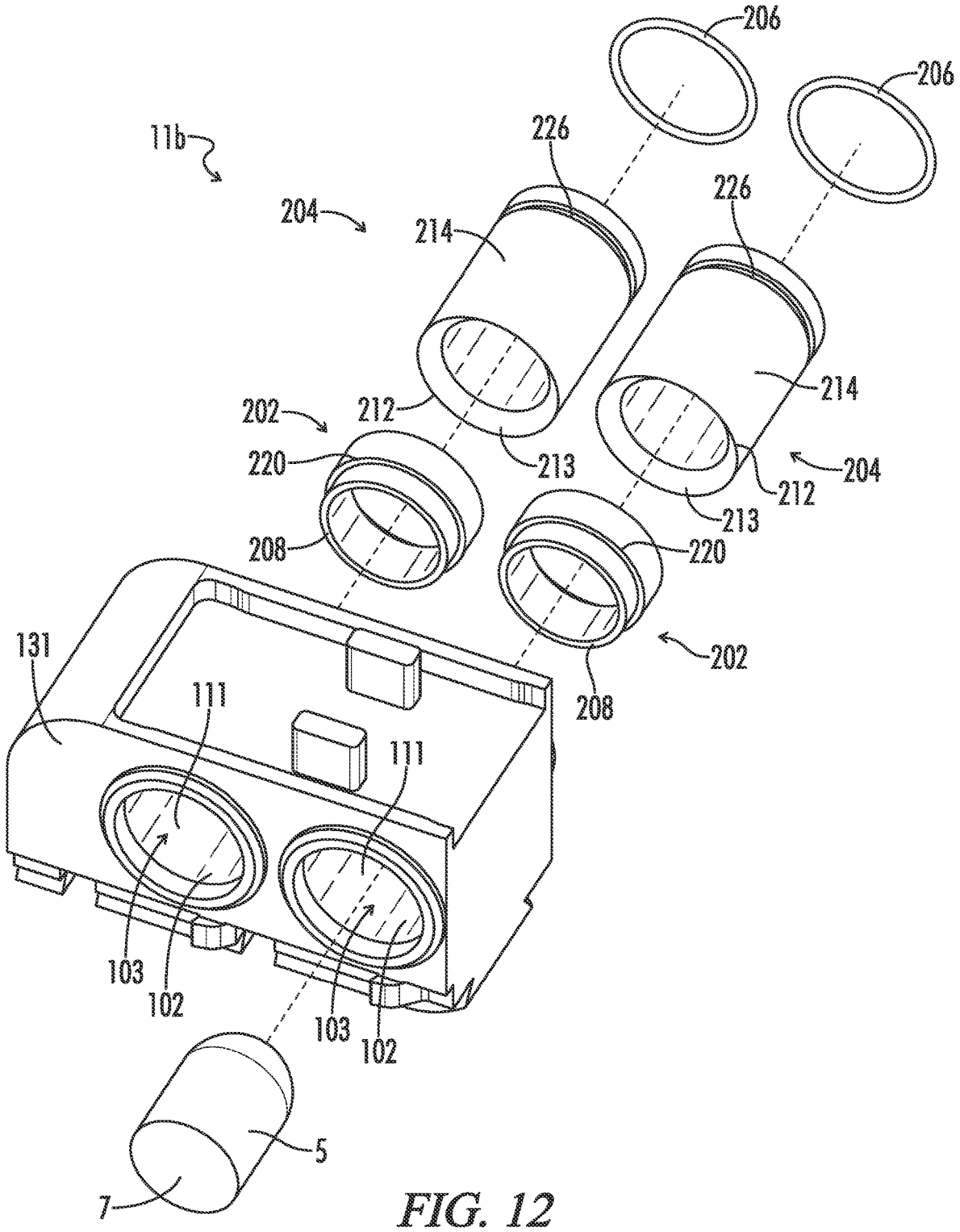
FIG. 12 is an elevated exploded rear isometric view of the magazine of FIG. 11.
Figure 13:
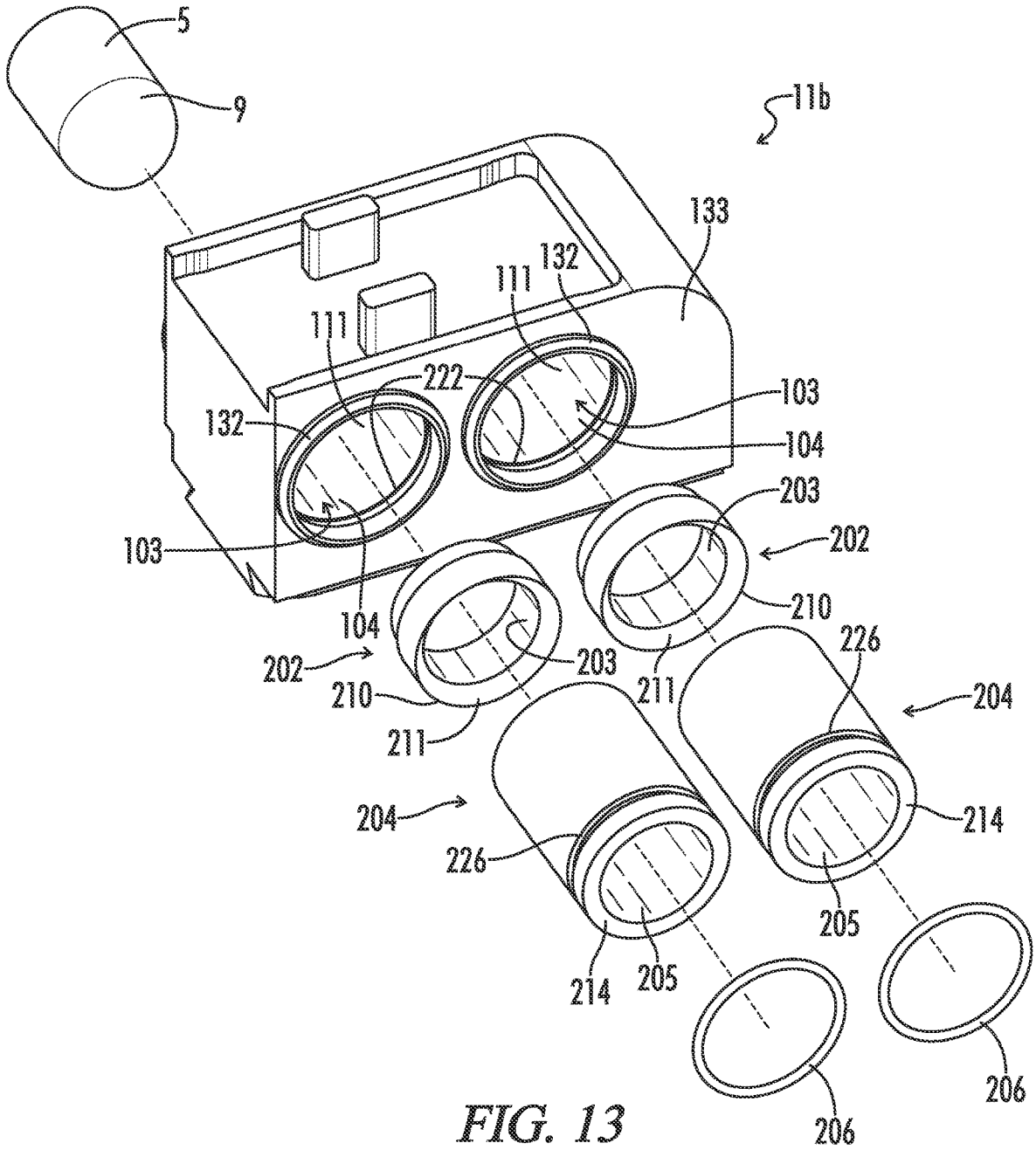
FIG. 13 is an elevated exploded front isometric view of the magazine of FIG. 11
Figure 14:
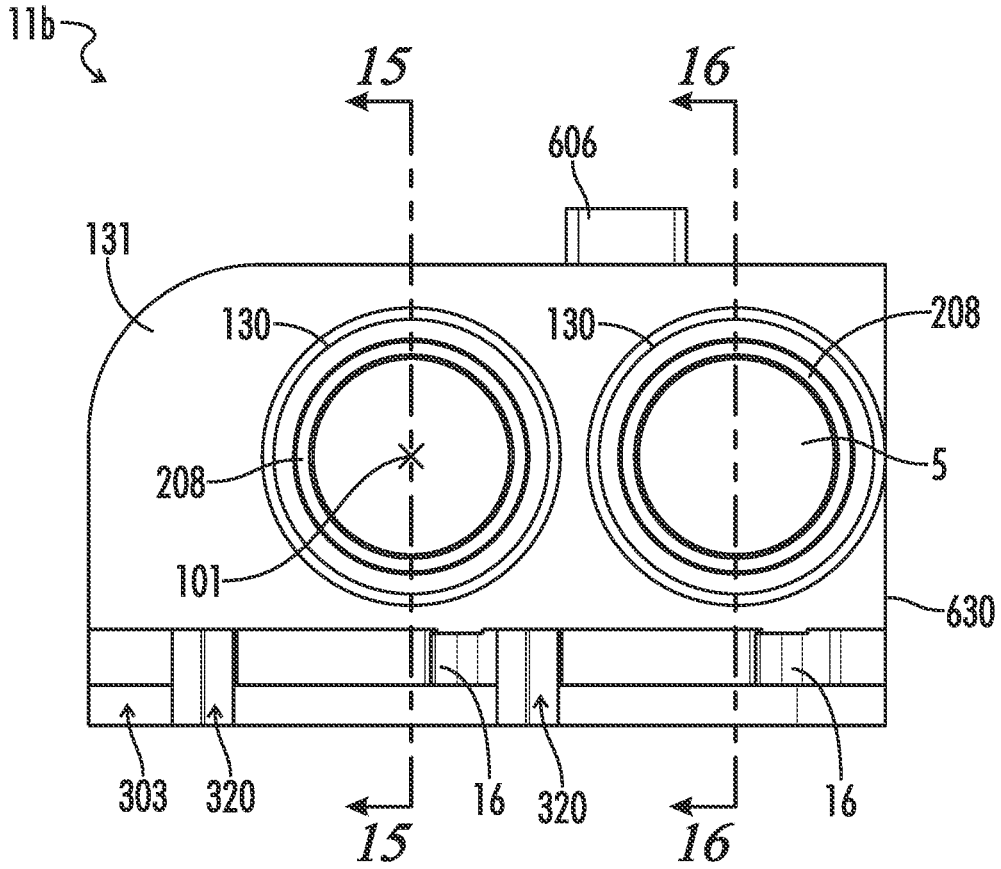
FIG. 14 is a rear perspective view of the magazine of FIG. 11.

In one embodiment, magazine 11 further includes a dovetail 303 (see FIG. 4). The dovetail 303 extends laterally along the magazine 11. The dovetail 303 is configured to engage a complementary track of the air gun 105 to align the magazine 11 within the air gun 105. In one embodiment, the dovetail 303 extends along the magazine 11 at a bottom 305 of the magazine 11, and forms the bottom 305 of the magazine 11. The bottom 305 of the magazine 11 is determined when the magazine 11 is in the upright position.

In one embodiment, the magazine 11 further includes a plurality of notches 320. Each notch 320 corresponds to a hole 103 of the plurality of holes. Each notch 320 is configured to receive a locator pin 321 of the air rifle 105. Each notch 320 is in the same position with respect to the hole 103 to which the notch 320 corresponds. Each notch 320 extends forward from the rear face 131 of the magazine 11. Each notch 320 is formed at the bottom 305 of the magazine 11.

In one embodiment, the magazine 11 further includes a plurality of gear teeth 16. Each gear tooth 16 corresponds to a hole 103 of the plurality of holes. Each gear tooth 16 is configured to engage a pawl arm 107 of the air gun 105 to stop the air gun 105 from advancing the magazine 11 to a next hole 103 of the plurality of holes 103. Each gear tooth 16 is in the same location with respect to the hole 103 corresponding to that gear tooth 16. Each gear tooth 16 extends rearward from the magazine 11. In one embodiment, each gear tooth 16 is above the laterally extending dovetail 303 of the magazine 11 and below the holes 103 when the magazine is in the upright position.

In one embodiment, the magazine 11 further includes a guide slot 13. The guide slot 13 extends laterally along the magazine 11. The guide slot 13 is configured to receive a complementary protrusion of the air rifle 105 to align the magazine 11 within the air rifle 105. In one embodiment, the guide slot 13 extends along the magazine 11 at a top 604 of the magazine 11. The top 604 of the magazine 11 is determined when the magazine 11 is in the upright position. In one embodiment, the magazine 11 further includes at least one guide 606 in the guide slot 13. The at least one guide 606 extends upwardly from the guide slot 13 when the magazine 11 is in the upright position. The at least one guide 606 is configured to engage a corresponding groove in the protrusion of the air rifle 105 to align the magazine 11 within the air rifle 105. The guide 606 may extend above the top face 604 of the magazine 11.

It will be understood that the magazine is preloaded with projectiles in the holes 103 or chambers (i.e., a user places projectiles in the holes 103), and the magazine body 11 is then inserted into the air gun 105. When a selected hole 103 or chamber is aligned with the bore 109 of the air gun 105 (i.e., the longitudinal axis of the barrel 505), the projectile can be fired directly from the chamber by a discharge of pressurized gas (e.g., air or helium) from the air output orifice 507 of the air gun 105 forcing the projectile out of the chamber and through the barrel 505 of the air gun 105.

In one embodiment, the magazine 11 is inserted into the air gun 105 by aligning the dovetail 303 with the complementary track of the air gun 105 and then aligning the guide slot 13 with the protrusion of the air gun 105. In one embodiment, a right end of the dovetail 303 is tapered or rounded to promote initial alignment of the dovetail 303 with the track. The user continues sliding the magazine 11 into the air rifle until the guides 606 engage the complementary groove in the protrusion of the air gun 105 and the magazine 11 is slid fully to the right (in a right-hand gun which may be reversed for a left-hand gun). A spring (not shown) of the air gun 105 at the right end 630 of magazine 11 (in a right-hand magazine and air gun) applies constant pressure to the right end or right face 630 of the magazine 11. After a shot, mechanically cocking the gun 105 using known mechanisms known to those skilled in the art moves the pawl arm 107 and allows the magazine 11 to advance to a next chamber or hole 103 (i.e., align the next hole 103 with a barrel 505 and output air orifice 507 of the rife) under the influence of the spring. That is, the pawl arm 107 is momentarily tripped, the spring slides the magazine 11 to the left, and the pawl arm 107 catches the next gear tooth 16 in the series. The locator pin 321 is then pressed into the corresponding notch 320 to precisely align the hole 103 with the barrel 505 and output air orifice 507 (and the associated barrel seal 506 and air orifice seal 508) to make the air gun 105 ready for the next shot.

Although sealing is important to higher muzzle energy output, there are no seals at the entrance and exit of each hole or chamber 103. The seals 506, 508 are mechanically trapped at the air output orifice 507 and at the entrance of the barrel 505. These seals have been tested for wear and pressure over 700×. The seals are mechanically trapped and created of a seal material which has enough lubricity to allow easy lateral movement across of the magazine body 11 and enough compression to seal against the front rim 132 and rear rim 130. The construction of the magazine 11 produces a chamber handling up to 6000 psi and operating nominally at 3000 psi in the air gun even though the magazine 11 does not have any seals attached thereto.

Turning now to FIGS. 11-20, there are shown multiple views of an embodiment of a dynamic sealing chamber magazine 11*b* for an air gun 105. Magazine 11*b* is identical to magazine 11 in all aspects of form and function except as subsequently herein described. Magazine 11*b* includes a plurality of chambers 101. Each chamber 101 of the plurality of chambers is configured to receive a projectile 5. Each chamber 101 includes a hole 103, a rear sleeve 202, a forward sleeve 204, and a retaining member 206. Each sleeve 202, 204 is a tubular liner externally dimensioned to be received in a portion of the hole 103 and internally dimensioned to receive the projectile 5 therein.

Upon firing, a pressurized gas G (indicated by arrows in FIG. 20) released by the air gun 105 pressurizes the chamber 101 and rapidly pushes the sleeves 202, 204 apart so that the sleeves 202, 204 protrude a distance from the hole 103 in opposite directions and engage corresponding opposing surfaces 502, 504 of the breech 501 of the air gun 105. Engagement of the sleeves 202, 204 with the breech surfaces 502, 504 causes the sleeves to temporarily seal against the breech surfaces 502, 504, thereby dynamically sealing chamber 101 so that a projectile 5 received therein can be propelled (i.e., fired) directly out of the chamber 101 and through the barrel 505 of the air gun 105. The sleeves 202, 204 then disengage from the breech surfaces 502, 504 after the projectile 5 has exited the chamber 101 so that the magazine 11*b* can be mechanically advanced to the next chamber 101 for a subsequent shot.

The sleeves 202, 204 are formed from a material which has enough lubricity to allow easy axial sliding movement of the sleeves 202, 204 within the holes 103 and enough compression for the sleeves 202, 204 to temporarily seal against opposing breech surfaces 502, 504, respectively, of the air gun 105 when the magazine 11*b* is in a dynamic sealing position (i.e., is pressurized upon discharge of the air gun), as described in more detail below. In some embodiments, the sleeves 202, 204 are formed from one or more synthetic polymers. Suitable synthetic polymers include but are not limited to polymers having high strength, stiffness, wear resistance, and lubricity (i.e., low-friction). In one embodiment, sleeves 202, 204 are formed from polyoxymethylene, also known as acetal, polyacetal, and polyformaldehyde, as well as by the trade name DELRIN®.

Each hole 103 extends from the front face 133 to the rear face 131 of the magazine 11*b*. Each hole 103 has a rear portion 102 and a forward portion 104. Each rear sleeve 202 is disposed in the rear portion 102 of each hole 103. Each forward sleeve 204 is disposed in the forward portion 104 of each hole 103. Each forward sleeve 204 is axially aligned (i.e., colinear) with the respective rear sleeve 202 in each hole 103. Each retaining member 206 is disposed in the forward portion 104 of each hole 103 and is configured to retain the respective rear and forward sleeves 202, 204 in their respective hole 103, as explained below.

Each rear sleeve 202 has a back end 208, a front end 210, and a chamfered surface 211 at the front end 210. Each forward sleeve 204 has a back end 212, a front end 214, and a chamfered surface 213 at the back end 212. Each forward sleeve 204 is disposed in each hole 103 in front of each rear sleeve 202 such that the back end 212 of the forward sleeve 204 is adjacent the front end 210 of the rear sleeve 202. The back end 212 of the forward sleeve 204 can be butted against the front end 210 of the rear sleeve 202.

Figure 15:
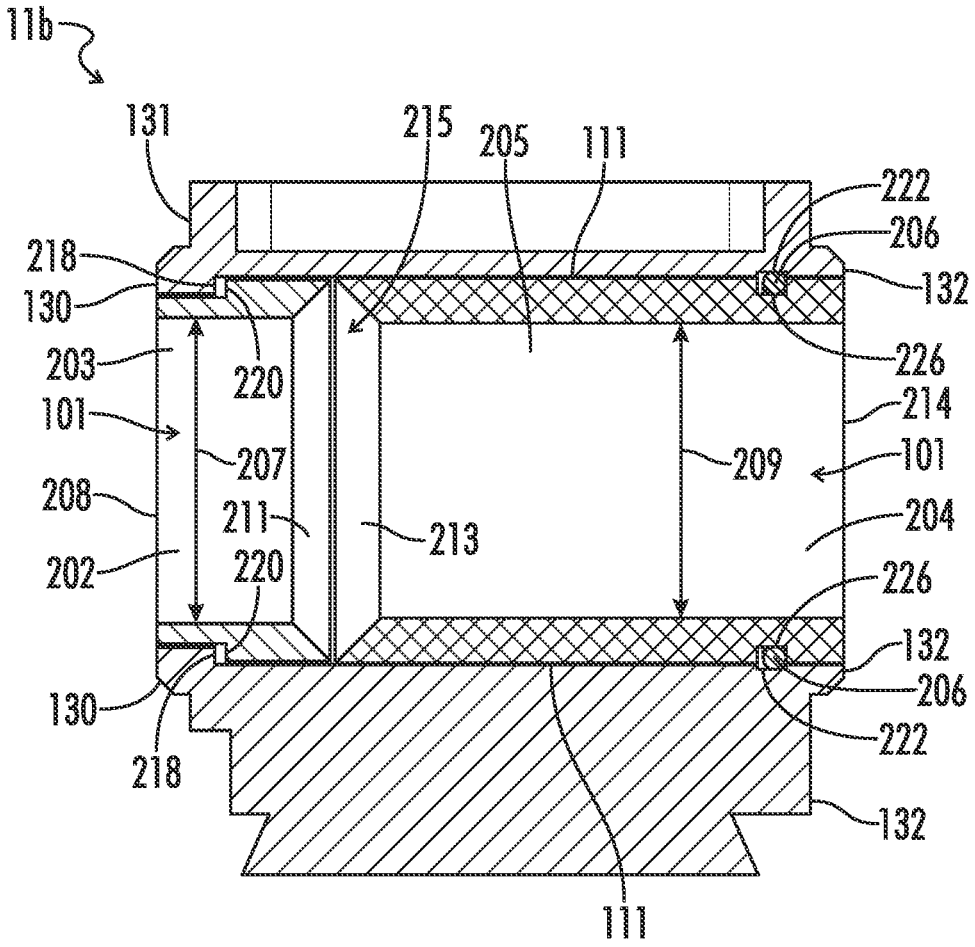
FIG. 15 is a sectional view taken along line A-A of FIG. 14.
Figure 16:
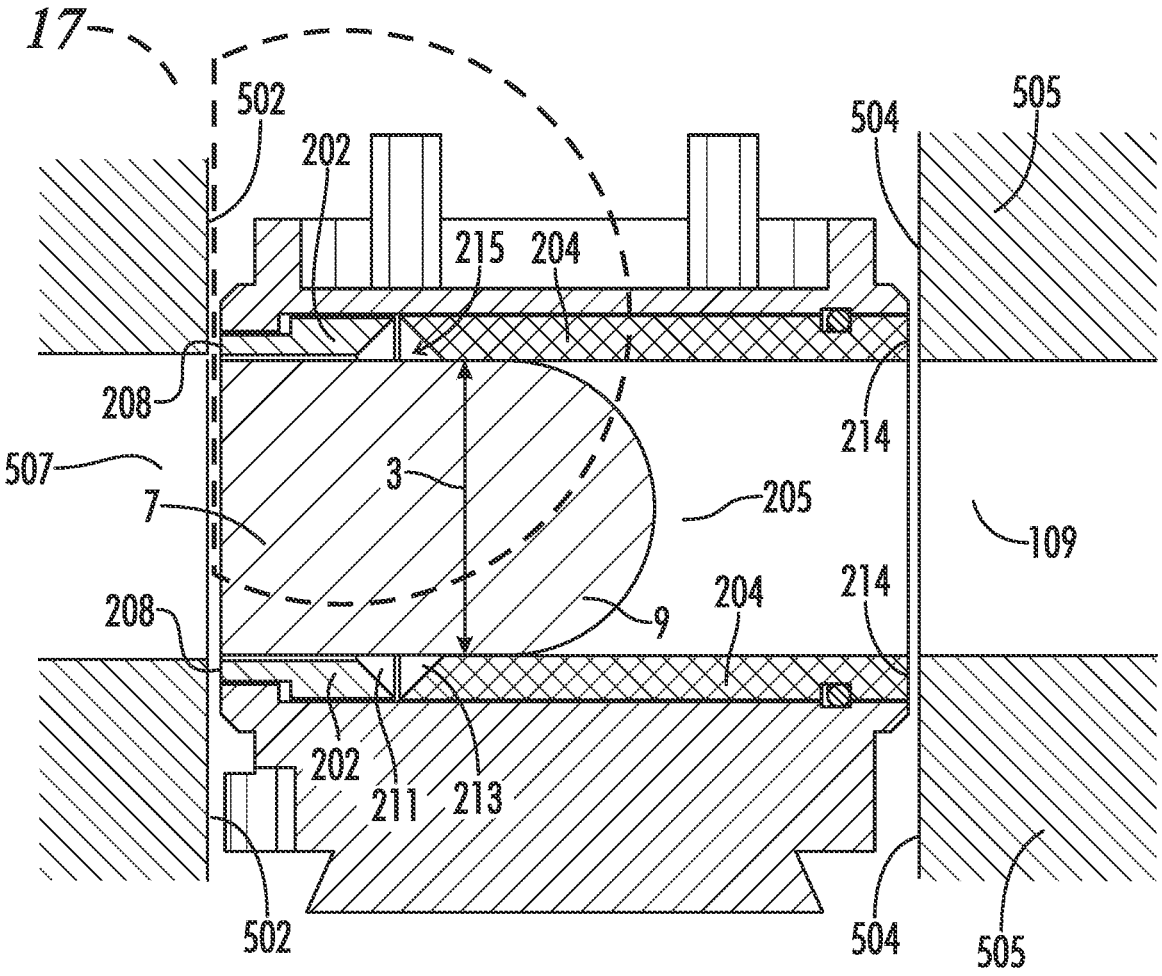
FIG. 16 is a sectional view taken along line B-B of FIG. 14. The magazine is shown received between opposing breech surfaces of an embodiment of the air gun with the chamber aligned with the air output orifice and the barrel bore in a position ready for firing. The breach surfaces are represented schematically. Other portions of the air gun are omitted for clarity.

In an embodiment, the back end 208 of the rear sleeve 202 does not protrude out of the hole 103 beyond the rear face 131 (the rear rim 130 is considered part of the rear face 131) of the magazine 11*b* when the associated chamber 101 is in a static, at rest position (i.e., not firing), as best shown in FIG. 15. The front end 214 of the forward sleeve 204 likewise does not does not protrude out of the hole 103 beyond the front face 133 (the front rim 132 is considered part of the rear face 133) of the magazine 11*b* when the associated chamber 101 is in a static, at rest position. However, in some embodiments, the back end 208 of the rear sleeve 202 and the front end 214 of the forward sleeve 204 can protrude a distance slightly beyond the respective rear and front faces 131, 133 of the magazine 11*b* (e.g., by about one or two thousandths of an inch) when the magazine 11*b* is in a static condition. In some embodiments, the sleeves 202, 204 can protrude enough to contact one or both of the respective air gun breech surfaces 502, 504. In such embodiments, the stiffness and lubricity of the constituent material of the sleeves 202, 204 allows the terminal ends 208, 214 of the sleeves 202, 204 to easily slide across the surface(s) 502, 504 of breech 501.

Figure 17:
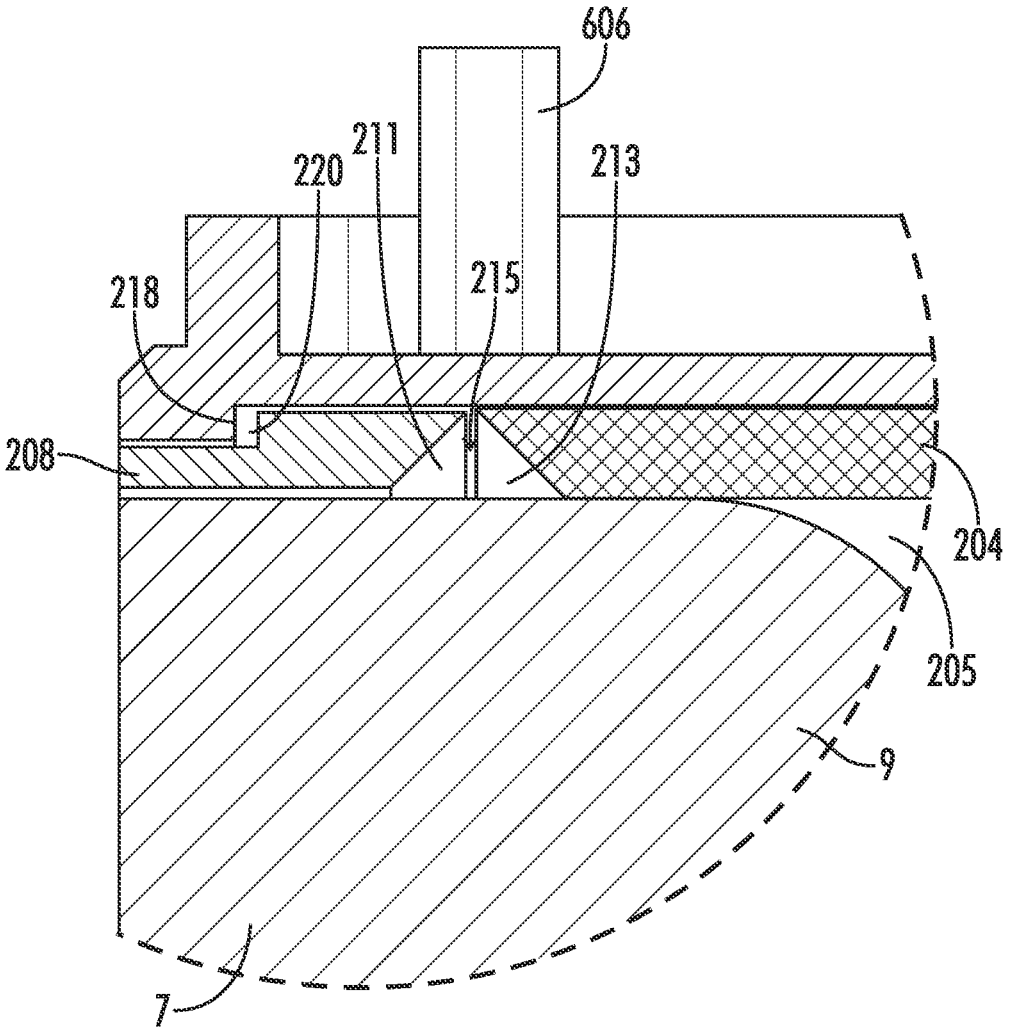
FIG. 17 is an enlarged detail view of location 17 of FIG. 16.
Figure 18:
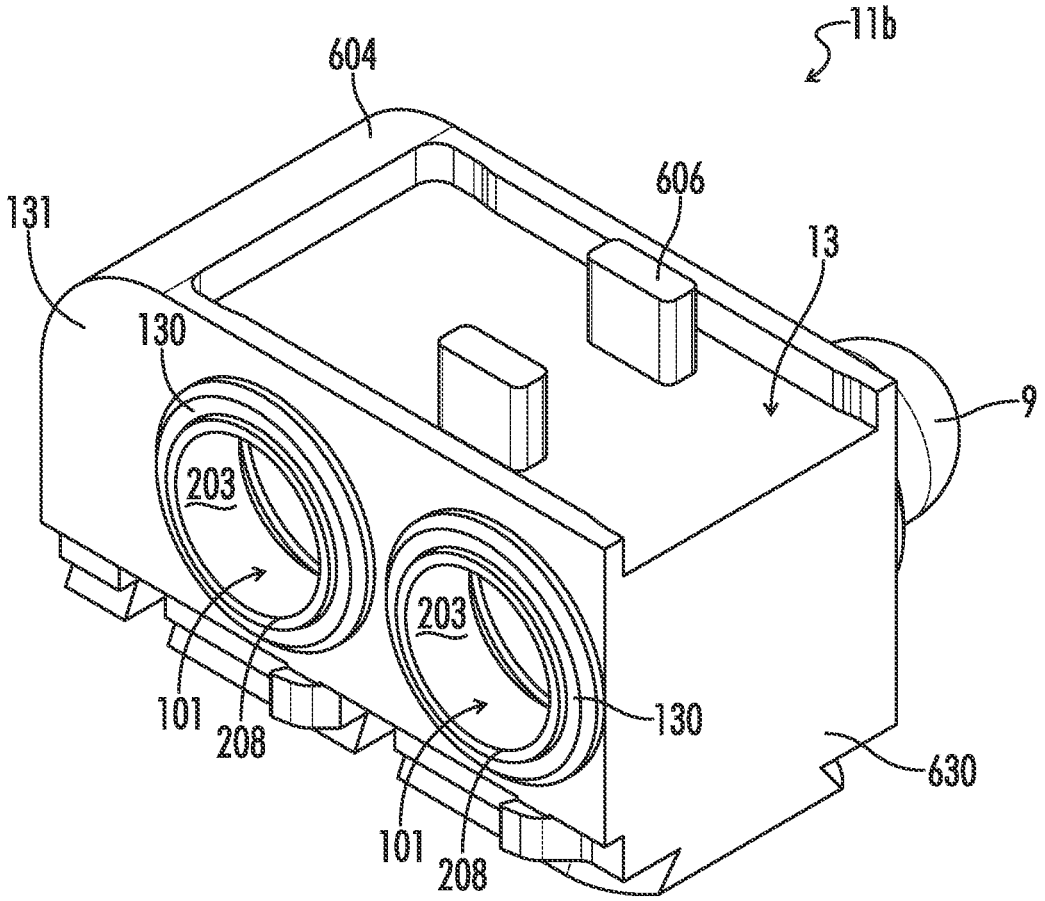
FIG. 18 is a rear isometric view of the magazine of FIG. 11 showing both chambers of the magazine in an actively-sealing (i.e., dynamic) position with the projectile protruding from the forward end of one chamber.
Figure 19:
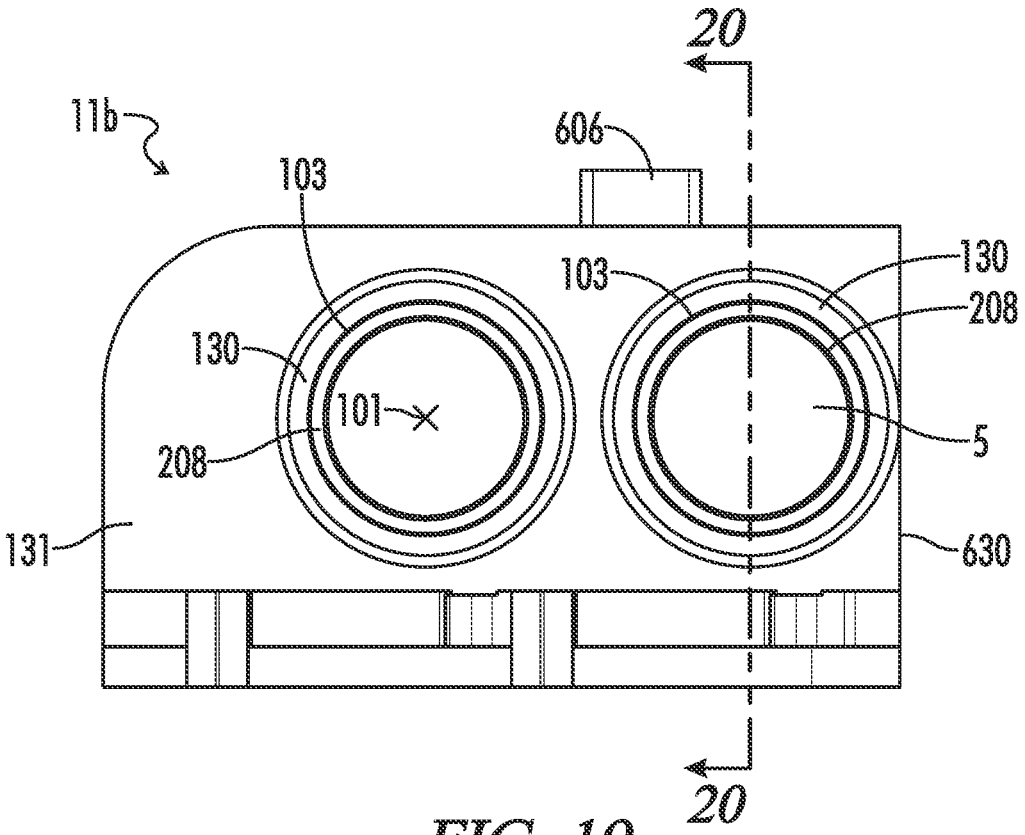
FIG. 19 is a rear perspective view of the magazine of FIG. 18.

The chamfered surface 211 of each rear sleeve 202 faces the chamfered surface 213 of the corresponding forward sleeve 204 in each hole 103. The respective chamfered surfaces 211, 213 define between them a concave space 215 into which pressurized gas released from the air output orifice 507 upon firing of the air gun 105 flows when the projectile 5 is received in the chamber 101 and the chamber is aligned with the barrel 505, as further explained below. In one embodiment, the concave space 215 has a generally triangular cross section, as best shown in FIG. 17. In other embodiments, chamfered surfaces 211, 213 can have a different angle, slope, or bevel that forms a concave space 215 having a different cross-sectional shape. In some embodiments, chamfered surfaces 211, 213 can be omitted, and the back end 212 of the forward sleeve 204 can be spaced from the front end 210 of the rear sleeve 202 to produce a gap between the sleeves 202, 204. However, it has been surprisingly discovered by the present inventors that use of chamfered surfaces 211, 213 aids in even distribution of gas around the concave space 215, which in turn causes the gas to more rapidly deploy sleeves 202, 204, as explained below.

Each rear sleeve 202 and forward sleeve 204 has a length extending along the longitudinal axis of the hole 103. The relative lengths of the rear sleeves 202 and forward sleeves 204 are configured such that the projectile 5 is partially received in each of the rear and forward sleeves 202, 204 of a given chamber 101 when the projectile 5 is received in the chamber 101 in a position ready for firing (i.e., the projectile is loaded in the chamber). Specifically, a rear portion 7 of the projectile 5 is received in the rear sleeve 202, while a front portion 9 of the projectile 5 is received in the forward sleeve 204. As such, the chamfered surfaces 211, 213 (and thus the concave space 215 defined therebetween) encircle the projectile 5 when the projectile is properly received or loaded in the chamber 101 in a position ready for firing.

The rear sleeve 202 is configured to allow pressurized gas released into the chamber upon firing the air gun 105 to flow around the rear portion 7 of the projectile 5 between the projectile 5 and the interior surface 203 of the rear sleeve 202 so that the gas enters the concave space 215 and contacts the back end 212 of the forward sleeve 204. The forward sleeve 204 is configured to substantially prevent the gas from flowing around the front portion 9 of the projectile 5 between the projectile 5 and the interior surface 205 of the forward sleeve 204 so that the gas also contacts the front end 210 of the rear sleeve 202 in the concave space 215. By the phrase "substantially prevent," it is meant that gas is completely or mostly prevented from flowing around the front portion 9 of the projectile such that enough pressurized gas remains in the chamber 101 to propel the projectile 5 out of the chamber 101 and through the bore of the barrel 505 of the air gun 105.

In one embodiment, the rear sleeve 202 has an internal diameter 207 that is greater than an exterior diameter 3 of the projectile 5, and the forward sleeve 204 has an internal diameter 209 that is substantially the same as the exterior diameter 3 of the projectile 5. By "substantially the same as" it is meant that the internal diameter 209 of the forward sleeve 204 differs from the exterior diameter 3 of the projectile 5 by an amount within the limits of commercially practicable manufacturing tolerances. In this way, the sleeves 202, 204 are configured to allow pressurized gas released into the chamber 101 to flow around the rear of the projectile 5 and into the concave space 215 before the projectile 5 substantially moves within the chamber 101. The projectile "substantially moves" when it begins to move forward within the forward sleeve 204 with enough force to exit the chamber 101 and enter the barrel bore 109 of the air gun 105.

The pressurized gas flowing into the space 215 applies a force to (i.e., pushes against) the opposing chamfered surfaces 211, 213 of the sleeves 202, 204.

The force of the pressurized gas pushing against the chamfered surfaces 211, 213 causes the sleeves 202, 204 to rapidly separate (i.e., pushes the sleeves apart) and protrude a distance axially out of the hole 103 in opposite directions (i.e., rearwardly and forwardly). This in turn causes the back end 208 of the rear sleeve 202 to engage the rear breech surface 502 (which can be an air orifice seal 508) around the air output orifice 507 and the front end 214 of the forward sleeve 204 to simultaneously engage the forward breech surface 504 (which can be the barrel 505 or a barrel seal 506) around the barrel bore 109.

The high pressure gas G slightly compresses the sleeves 202, 204 against the respective breech surfaces 502, 504, thereby sealing the associated chamber 101 to the air output orifice 507 and the barrel bore 109 before the projectile 5 substantially moves within the chamber 101. Put differently, engagement of the rear sleeve 202 with the rear breech surface 502 prevents the pressurized gas from escaping the air gun 105 where the magazine 11*b* interfaces with the air output orifice 507. Engagement of the forward sleeve 204 with the forward breech surface 504 likewise prevents the pressurized gas from escaping the air gun 105 where the magazine 11*b* interfaces with the barrel 505.

Compression of the sleeves 202, 204 against breech surfaces 502, 504 also holds the magazine 11*b* in place in the breech 501 of the air gun 105 and prevents perpendicular movement of the magazine 11*b* relative to the barrel bore 109 during firing. Decompression and disengagement of the sleeves 202, 204 from the respective breech surfaces 502, 504 unseals the chamber 101 and enables perpendicular movement of the magazine 11*b* relative to the barrel bore 109 for alignment with the barrel bore 109 of another chamber 101 for a subsequent shot or extraction of the magazine 11*b* from the air gun 105.

The sleeves 202, 204 decompress and disengage from the breech surfaces 502, 504, respectively, when the force applied to the sleeves by the pressurized gas decreases below the elastic potential energy of the sleeves 202, 204. The elastic energy potential of the sleeves 202, 204 is dependent upon the constituent material from which the sleeves are formed. In some embodiments, the force applied to the sleeves 202, 204 by the pressurized gas decreases below the elastic potential energy of the sleeves after the projectile 5 has exited the chamber 101. In some embodiments, the force applied to the sleeves 202, 204 by the pressurized gas decreases below the elastic potential energy of the sleeves after the pressure in the chamber 101 has substantially dissipated. By "substantially dissipated" it is meant that the pressure in the chamber 101 has decreased to a pressure approximating that the surrounding atmospheric pressure. In one embodiment, the force applied to the sleeves 202, 204 by the pressurized gas decreases below the elastic potential energy of the sleeves after the projectile 5 has exited the barrel 505 of the air gun 105.

During decompression (e.g., when the magazine 11*b* returns to a static position), the elastic modulus of the constituent material causes each pair of rear and forward sleeves 202, 204 to move back into the associated hole 103 by the distance of initial compression under load from the pressurized gas G. In some embodiments, the ends of the sleeves 202, 204 can remain protruding out of the hole 103 beyond the rear and forward faces 131, 133 of the magazine 11*b* after the magazine 11*b* has returned to static. As noted above, the lubricity of the material from which the sleeves 202, 204 are formed allows the ends of the sleeves 202, 204 to easily slide across the breech surfaces 502, 504 perpendicular to the bore 109.

Dynamic sealing chamber magazines 11*b* do not have or require traditional static seals (e.g., rubber O-rings) on either the rear 131 or front 133 face of the magazine body 11*b* because the rear and forward sleeves 202, 204 function to automatically compressively seal against the respective breech surfaces 502, 504 of the air gun 105 during firing, as described above. Moreover, air guns with which magazines 11*b* are compatible can have but do not require traditional static seals at either of the rear or front breech surfaces 502, 504, respectively. However, in some embodiments, the rear breech surface 502 can be the air orifice seal 508 around the air output orifice 507 of air gun 105, and the forward breech surface 504 can be the barrel seal 506 around the barrel bore 109. In other embodiments, the barrel seal 506 and the air orifice seal 508 can be omitted. In such embodiments, the rear breech surface 502 can be a smooth, flat, metal or plastic surface surrounding an air output orifice 507, and the forward breech surface 504 can be a smooth, flat, metal or plastic surface surrounding the barrel bore 109, such as the barrel 504, as exemplified in FIG. 20.

Figure 20:
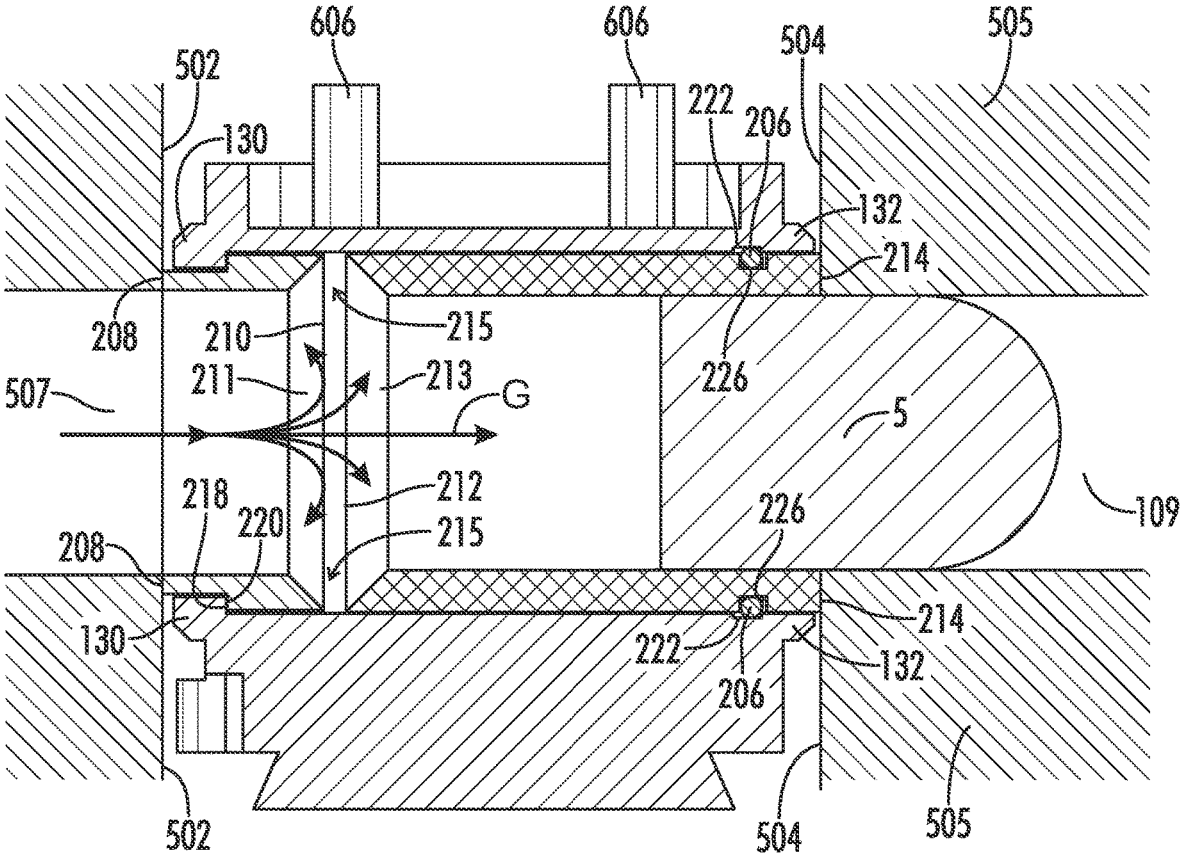
FIG. 20 is a sectional view taken along line C-C of FIG. 19. The magazine is again shown received between opposing breech surfaces of an embodiment of the air gun with the chamber aligned with the air output orifice and the barrel bore and the projectile entering the barrel bore shortly after firing. The breach surfaces are represented schematically. Other portions of the air gun are omitted for clarity.

Referring now to FIGS. 15 and 20, the sleeves 202, 204 are mechanically retained inside each chamber hole 103. In one embodiment, the interior surface 111 of the rear portion 102 of each hole 103 defines a ledge 218 and an exterior surface of the rear sleeve 202 defines a lip 220. The lip 220 is configured to interface with (i.e., contact) the ledge 218 when the sleeve 202 is moved rearwardly within the hole 103 and thereby prevent the sleeves 202, 204 from rearwardly exiting the hole 103. This arrangement enables each pair of sleeves 202, 204 to be installed in each hole 103 from the forward end 104 without the sleeves falling out of the rear end 102 of the hole 103.

In order to prevent the sleeves 202, 204 from inadvertently falling out of the forward end 104 of the hole 103, the interior surface 111 of the forward portion 104 of each hole 103 defines a channel 222 and an exterior surface of the forward sleeve 204 defines a groove 226. The groove 226 aligns with the channel 222 when the forward sleeve 204 is received or seated in the forward end 104 of the hole 103. The retaining member 206 is received in the channel 222 and the groove 226. The retaining member 206 is sized to occupy both the channel 222 and the groove 226 when the retaining member 206 is received therein. In this way, the retaining member 206 prevents sleeves 202, 204 from exiting the front end 104 of the hole 103, for example, when the magazine 11*b* not received in (i.e., outside) the air gun 105.

The retaining member 206 can be formed any one or more tear-resistant materials, including metallic and polymeric materials. However, the use of a highly deformable material such as rubber can facilitate assembly and disassembly of the magazine 11*b*, whether during manufacture or maintenance (e.g., replacement of sleeves 202, 204). Use of such deformable materials can also facilitate retraction of the forward sleeve 204 back into the hole 103 as the retaining member 206 itself decompresses after the chamber 101 ceases to be pressurized. This is because the forward axial movement of the forward sleeve 204 during firing causes an edge of the groove 226 to compress the retaining member 206 into an opposing edge of the channel 222. As such, in one embodiment, the retaining member is a rubber O-ring 206.

It is to be understood that the directionality and positioning of the foregoing sleeve retention structures within magazine 11*b* can be reversed, such that the sleeves are prevented from falling out the front end of the hole by contact between the ledge 218 and lip 220, and prevented from falling out the back end 102 of the hole 103 by the retaining member 206 interfacing with the channel 222 and groove 226. Other possible variations will be apparent to those of skill in the art.

It is also to be understood that while the embodiment of a dynamic sealing chamber magazine 11*b* depicted in the figures is presented as a linear chamber magazine, in additional embodiments, a dynamic sealing chamber magazine formed in accordance with the principles of the present invention could take the form of a rotary magazine or other non-linear magazine. It is further to be understood that while the embodiment of a dynamic sealing chamber magazine 11*b* depicted in the figures includes rear and front rims 130, 132 protruding from the rear and front faces of the magazine body 11*b*, respectively, in some embodiments, rims 130, 132 can be omitted such that the front and rear faces 133, 131 of the magazine body are entirely planar. It is further contemplated that in certain alternate embodiments, the rear and forward sleeves 202, 204 can be combined or connected, including, for example, by one or more strips of an elastic material, such that a dynamic sealing chamber magazine is formed with a single bidirectionally extendable sleeve or two sleeves integrally formed as one. In additional alternate embodiments, one of the rear or forward sleeves 202, 204 can be omitted such that a dynamic sealing chamber magazine which dynamically seals in only one direction results.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims Thus, although there have been described particular embodiments of the present invention of a new and useful DYNAMIC SEALING CHAMBER MAGAZINE it is not intended that such references be construed as limitations upon the scope of this invention except as set forth in the following claims.

What is claimed is:

1. A magazine for an air gun, the magazine comprising:

a plurality of chambers extending through the magazine, each chamber configured to receive a projectile, each chamber comprising:

a hole extending through the magazine, a first sleeve in which the projectile is receivable disposed in the hole, and a second sleeve in which the projectile is receivable disposed in the hole proximate to the first sleeve;

wherein the first and second sleeves are configured to temporarily engage and seal against respective first and second surfaces of the air gun upon release of a pressurized gas provided by the air gun into the chamber when the projectile is received in the chamber and the chamber is aligned with the barrel bore.

2. The magazine of claim 1, wherein release into the chamber of the pressurized gas when the projectile is received in the chamber and the chamber is aligned with the barrel bore causes the first sleeve to protrude out of the hole in a first direction to engage the first surface of the air gun, and causes the second sleeve to protrude out of the hole in a second direction to engage a second surface of the air gun.

3. The magazine of claim 1, wherein:

engagement of the first sleeve with the first surface of the air gun prevents the pressurized gas from escaping the air gun where the magazine interfaces with an air output orifice of the air gun; and engagement of the second sleeve with the second surface of the air gun prevents the pressurized gas from escaping the air gun where the magazine interfaces with a barrel of the air gun.

4. The magazine of claim 1, wherein:

the first and second sleeves are configured to be compressed by the pressurized gas against the respective first and second surfaces of the air gun upon release of the pressurized gas into the chamber; and the first and second sleeves are configured to decompress and disengage from the respective first and second surfaces of the air gun when a force applied to the first and second sleeves by the pressurized gas decreases below an elastic potential energy of the first and second sleeves.

5. The magazine of claim 4, wherein:

compression of the first and second sleeves against the respective first and second surfaces of the air gun seals the chamber to the first and second surfaces of the air gun and prevents perpendicular movement of the magazine relative to the barrel bore; and decompression of the first and second sleeves from the respective first and second surfaces of the air gun unseals the chamber from the first and second surfaces of the air gun and enables perpendicular movement of the magazine relative to the barrel bore.

6. The magazine of claim 1, wherein the first and second sleeves do not seal against the first and second surfaces of the air gun when the projectile is not received in the chamber or the pressurized gas is absent from the chamber.

7. The magazine of claim 1, wherein:

the first and second sleeves are configured within the hole such that the projectile is partially received in each of the first and second sleeves when the projectile is received in the chamber;

the first sleeve is configured to allow the pressurized gas to flow around a rear portion of the projectile between the projectile and the first sleeve such that the pressurized gas contacts a rear surface of the second sleeve when the pressurized gas is released into the chamber while the projectile is received in the chamber; and the second sleeve is configured to substantially prevent the pressurized gas from flowing around the projectile between the projectile and the second sleeve such that the pressurized gas also contacts a forward surface of the first sleeve when the pressurized gas is released into the chamber while the projectile is received in the chamber.

8. The magazine of claim 1, wherein the first and second sleeves are configured to be pushed apart by the pressurized gas upon release of the pressurized gas into the chamber such that the first and second sleeves protrude out of the hole in opposite directions and respectively engage the first and second surfaces of the air gun before the projectile substantially moves in the chamber.

9. The magazine of claim 1, wherein:

the first sleeve has an angled forward surface;

the second sleeve has an angled rear surface;

the angled forward surface of the first sleeve and the angled rear surface of the second sleeve define a space into which the pressurized gas flows upon release of the pressurized gas into the chamber when the projectile is received in the chamber and encircled by the space; and the first and second sleeves are pushed into respective engagement with the first and second surfaces of the air gun by the pressurized gas when the pressurized gas flows into the space.

10. The magazine of claim 9, wherein:

the projectile has an exterior diameter;

the first sleeve has an internal diameter that is greater than the exterior diameter of the projectile; and the second sleeve has an internal diameter that is substantially the same as the exterior diameter of the proj ectile.

11. The magazine of claim 1, wherein each chamber further comprises a retaining member received in the chamber, the retaining member configured to interface with the hole and one of the first sleeve or the second sleeve and thereby prevent at least one of the first sleeve and the second sleeve from exiting the hole.

12. The magazine of claim 1, wherein:

an interior surface of the hole defines a ledge; and an exterior surface of the first sleeve defines a lip configured to interface with the ledge and thereby prevent the first and second sleeves from exiting the hole in a first direction.

13. The magazine of claim 12, wherein:

an interior surface of the hole defines a channel;

an exterior surface of the second sleeve defines a groove; and the magazine further comprises a retaining member receivable in the channel and the groove, the retaining member configured prevent the first and second sleeves from exiting the hole in a second direction.

14. A magazine for an air gun, the magazine comprising:

a magazine body having a front face and a rear face; and a plurality of chambers extending through the magazine body, each chamber configured to receive a projectile, each chamber comprising:

a hole extending from the front face to the rear face of the magazine body, a first sleeve disposed within the hole, and a second sleeve disposed within the hole colinear to the first sleeve;

wherein the first and second sleeves are configured to temporarily sealingly engage respective first and second surfaces of the air gun upon release into the chamber of a pressurized gas provided by the air gun when the projectile is received in the chamber and the chamber is aligned with a barrel bore of the air gun.

15. The magazine of claim 14, wherein the first and second sleeves are configured to disengage from the respective first and second surfaces of the air gun after the projectile has exited the chamber and a force applied to the first and second sleeves by the pressurized gas has decreased below an elastic potential energy of the first and second sleeves.

16. The magazine of claim 14, wherein:

the first sleeve has a chamfered forward surface;

the second sleeve has a chamfered rear surface;

the chamfered forward surface of the first sleeve and the chamfered rear surface of the second sleeve define a space into which the pressurized gas flows upon release of the pressurized gas into the chamber when the projectile is received in the chamber and encircled by the space; and the pressurized gas upon flowing into the space pushes the first and second sleeves apart and into sealingly engagement with the respective first and second surfaces of the air gun before the projectile substantially moves in the chamber.

17. A magazine for an air gun, the magazine comprising:

a magazine body having a front face and a rear face; and a plurality of chambers extending through the magazine body, each chamber configured to receive a projectile and comprising:

a hole extending from the front face to the rear face of the magazine body, a rear sleeve disposed within the hole, and a forward sleeve disposed within the hole adjacent to the rear sleeve;

wherein the rear and forward sleeves are formed from a synthetic polymeric material and are configured to be pushed apart by a pressurized gas upon release of the pressurized gas into the chamber when the projectile is received in the chamber and the chamber is aligned with an air output orifice and a barrel bore of the air gun such that said sleeves extend out of the hole in opposite directions and compressively seal around the air output orifice and the barrel bore of the air gun, then decompress and unseal from around the air output orifice and the barrel bore when a force applied to the said sleeves by the pressurized gas decreases below an elastic potential energy of said sleeves.

18. A magazine for an air gun, the magazine comprising:

a plurality of chambers extending through the magazine, each chamber configured to receive a projectile and comprising:

a hole extending through the magazine, and at least one sleeve in which the projectile is receivable disposed within the hole;

wherein the at least one sleeve is configured to be compressed against and thereby engage at least one surface of the air gun upon release of a pressurized gas provided by the air gun into the chamber when the projectile is received in the at least one sleeve and the chamber is aligned with the barrel bore, and then decompress and disengage from the at least one surface of the air gun when a force applied to the at least one sleeve by the pressurized gas decreases below an elastic potential energy of the at least one sleeve.

* * * * *